US007328476B1

(12) United States Patent
Heidemeyer, Jr.

(10) Patent No.: US 7,328,476 B1
(45) Date of Patent: Feb. 12, 2008

(54) FOOT CLEANING DEVICE

(76) Inventor: Darwin Heidemeyer, Jr., 1595 Darst Creek La., Seguin, TX (US)

( * ) Notice: Subject to any disclaimer, the term of this patent is extended or adjusted under 35 U.S.C. 154(b) by 524 days.

(21) Appl. No.: 10/786,746

(22) Filed: Feb. 25, 2004

(51) Int. Cl.
*B08B 1/00* (2006.01)

(52) U.S. Cl. ..... 15/104.92; 15/106; 15/160; 601/114; 601/128

(58) Field of Classification Search ..... None
See application file for complete search history.

(56) References Cited

U.S. PATENT DOCUMENTS 3,548,439 A 12/1970 Berst
3,939,825 A * 2/1976 Krummenacher ..... 601/104
4,617,917 A 10/1986 Miller
5,321,867 A 6/1994 Probst
5,473,788 A 12/1995 Aragona
2005/0211270 A1* 9/2005 Wheelwright ..... 134/6

FOREIGN PATENT DOCUMENTS

JP 2001224653 A * 8/2001

* cited by examiner

*Primary Examiner*—David Redding

(57) ABSTRACT

The present invention is a foot cleaning device for accommodating a foot and thoroughly cleaning the foot positioned within the device. The foot cleaning device has a foot receptacle, scrub brushes, roller brushes, a liquid dispensing assembly for carrying water and soap into the receptacle, and spray jets attachable to the liquid dispensing assembly for dispersing the water and soap throughout the receptacle. The scrub brushes are distributed throughout the foot receptacle for allowing the user to clean his or her feet. The roller brushes are positioned along the bottom of the foot receptacle for massaging, cleaning, and supporting the user's foot within the receptacle.

27 Claims, 6 Drawing Sheets

FOOT CLEANING DEVICE

BACKGROUND OF THE INVENTION

1. Field of the Invention

Applicants' invention relates to a device for cleaning an individual's foot. More particularly, it relates to a boot-like device with a plurality of spray jets and scrubbers for cleaning a foot.

2. Background Information

The invention relates to a foot cleaning device. In particular the invention is a foot receptacle having brushes incorporated therein for scrubbing and cleaning the foot. An inlet tube disperses water and soap into the receptacle and channels allow the water and soap to be drained therefrom.

Good hygiene is very important to most people. However, because of infirmities and physical incapacities, such as old age and back ailments, certain parts of the body become hard to reach and therefore hard to properly clean. Such a body part is the foot. Failure to clean the feet can result in numerous diseases and discomfort to the feet.

Further many people prefer to take a shower rather than bathe. When showering, the person is standing upright in a bathtub or shower stall, leaving little room to move about. Thus, in order to effectively clean his or her feet, it would be necessary to stand on one foot while raising the other foot to be cleaned. As the shower floor is typically covered with water and soap, thereby creating a slippery surface, this can be quite dangerous.

Thus, there exists a need for a foot cleaning device that allows a person to clean his or her feet while remaining in a standing position. The device comprises a receptacle for accommodating a foot, a plurality of brushes for cleaning the foot, and an inlet tube for dispensing with the water and soap throughout the receptacle. Thus, the user may effectively cleanse his or her foot without having to bring his or her hands into contact with the foot. The foot is simply inserted into the receptacle and maneuvered therein.

U.S. Pat. No. 4,617,917 to Miller discloses a foot hygiene device that has a foundation member on which the user's foot is placed. A plurality of brushes which line the foundation member are utilized in scrubbing the foot. Because of the construction of the device, there is no means by which to cleanse the top portion of the foot.

U.S. Pat. No. 3,548,439 to Berst discloses a foot soaping and scrubbing device that comprises a receptacle having an arch for accommodating a foot. Scrubbing bristles extend outward from the receptacle for cleansing the foot.

U.S. Pat. No. 5,321,867 to Probst discloses a foot washing apparatus for allowing a person to wash his or her feet while standing upright. The apparatus comprises a housing and a plurality of brushes strategically placed along the housing.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved foot cleaning device. As such, the general purpose of the present invention, which will be described subsequently in greater detail, is to provide a new and improved foot cleaning device which has all the advantages of the prior art and none of the disadvantages.

To attain this, the present invention essentially comprises a foot cleaning device for accommodating a foot and thoroughly cleaning the foot positioned within the device. The foot cleaning device has a foot receptacle, scrub brushes, roller brushes, a liquid dispensing assembly for carrying water and soap into the receptacle, and spray jets attachable to the liquid dispensing assembly for dispersing the water and soap throughout the receptacle. The scrub brushes are distributed throughout the foot receptacle for allowing the user to clean his or her feet. The roller brushes are positioned along the bottom of the foot receptacle for massaging, cleaning, and supporting the user's foot within the receptacle. It is anticipated that both the scrub brushes and the roller brushes could be equipped with a variety of different surfaces or tips, such as for cleaning, massaging, or smoothing the user's foot. The brushes can also assist in supporting the user's foot.

It is an object of the invention to produce a foot cleaning device that allows a person to clean his or her foot while remaining in a standing or upright position. Accordingly, the device comprises a foot receptacle that accommodates the foot, and a plurality of brushes positioned within the receptacle for cleaning the foot. Thus, the user may simply place his or her foot into the receptacle and maneuver the foot therein until sufficiently cleansed.

It is a further object of the invention to produce a foot cleaning device that may be utilized on any surface. Accordingly, the device comprises a bottom surface having suction cups that may attach to a flat surface. Alternatively, a sole portion may be attached to the receptacle, the sole having a textured bottom surface for providing a grip on uneven surfaces.

It is a further object of the invention to produce a foot cleaning device that allows the user to cleanse his or her feet, as well as provide a means for draining the soap and water from the receptacle. Accordingly, an inlet tube is mated with the receptacle for dispensing water and soap, and a plurality of slots and channels allow the water and soap to be drained therefrom.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

| | |
|---|---|
| 10 | foot cleaning device |
| 12 | foot |
| 12H | heel |
| 12F | foot top portion |
| 12T | toe |
| 12S | foot sole |
| 12A | ankle |
| 14 | foot receptacle |
| 14T | foot receptacle top surface |
| 14B | foot receptacle bottom surface |
| 14L | foot receptacle flange |
| 14F | foot receptacle front portion |
| 14R | foot receptacle rear portion |
| 14S | foot receptacle side |
| 15 | opening |
| 16 | scrub brush |
| 16B | scrub brush bristle |
| 16H | scrub brush head |
| 17 | pin hole |
| 18 | roller brush |
| 18A | roller brush axle |
| 18T | roller brush teeth |
| 18P | roller brush locking pin |
| 18S | roller brush spring |
| 18E | roller brush end |
| 20 | liquid dispensing assembly |
| 22 | spray jet tube |
| 22A | spray jet |
| 24 | bottom channel |
| 26 | suction cup |
| 28 | sole |
| 28T | sole top surface |
| 28B | sole bottom surface |
| 30 | stud |
| 32 | sole top surface groove |
| 34 | perforation |
| 36 | coupling |
| 37 | manifold |
| 38 | inlet pipe |
| 38M | inlet pipe midway point |
| 38B | inlet pipe bottom end |
| 38T | inlet pipe top end |
| 40 | shower head |
| 40P | shower head pipe |
| 42 | valve |
| 44 | first additive dispensing assembly |
| 44V | additive dispensing assembly valve |
| 44T | additive dispensing assembly tube |
| 46 | shaft |
| 46B | shaft bottom portion |
| 46A | shaft bottom portion bottom end |
| 46M | shaft middle portion |
| 46T | shaft top potion |
| 46E | shaft top portion top end |
| 48 | nipple |
| 50 | funnel |
| 52 | hook |
| 54 | second additive dispensing assembly |
| 56 | shaft additive valve |
| 58 | front opening |
| 60 | rear opening |
| 100 | user |

DETAILED DESCRIPTION OF THE PREFERRED EMBODIMENT

Figure 1:
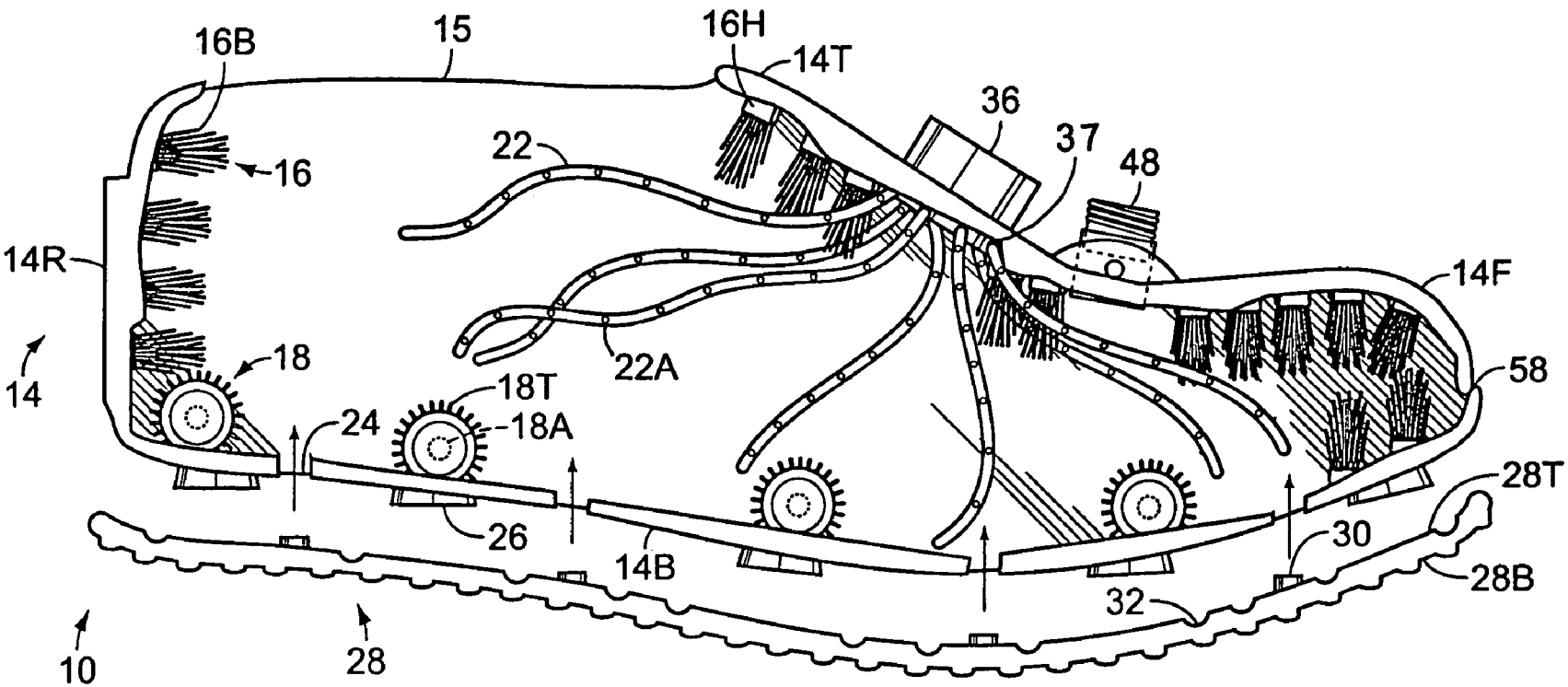
FIG. 1. is a side elevational view of the foot cleaning device, with parts broken away, illustrating attachment of the sole portion to the foot receptacle.

Referring to the figures, FIG. 1. a foot cleaning device 10 for accommodating a foot 12 and cleansing the foot 12 positioned therein. The foot cleaning device 10 essentially comprises a foot receptacle 14, a plurality of scrub brushes 16, a plurality of roller brushes 18, a liquid dispensing assembly 20, and a plurality of spray jet tubes 22 attached to the liquid dispensing assembly 20. The receptacle 14 comprises a top surface 14T, a bottom surface 14B, a front portion 14F, a rear portion 14R, and a pair of sides 14S, whereby an interior volume is formed for accommodating the user's 100 foot 12. The receptacle has an opening 15 through which the foot 12 may be inserted.

A foot receptacle flange 14L may comprise a portion of the bottom surface 14B. If necessary, it is anticipated that the foot receptacle flange 14L may be made of a relatively more rigid material than the remainder of the foot receptacle 14 in order to provide more stable structure for the foot receptacle 14. The foot receptacle flange 14L circumscribes the foot receptacle bottom surface 14B, and extends partway up the foot receptacle side 14S.

A plurality of scrub brushes 16 are positioned on the interior of the foot receptacle 14, each brush 16 comprising a head 16H and a plurality of bristles 16B emanating from the head 16H. The scrub brushes 16 are strategically placed within the foot receptacle 14 in order to allow the user 100 to thoroughly clean all parts of his or her feet 12. In particular, brushes 16 extend outward horizontally from the receptacle rear portion 14R, downward vertically from the receptacle top surface 14T, upward vertically from the receptacle bottom surface 14B, and outward horizontally from the receptacle front portion 14F. It should be noted that each brush 16 can be angled as desired.

These scrub brushes 16 primarily serve to clean the foot 12, particularly the heel 12H, the foot top surface 12F, and the toes 12T. The scrub brush bristles 16B may be available in different degrees of rigidity depending on the location of the brushes 16 within the foot receptacle 14. By way of example, the brushes 16 positioned at the front portion 14F may have coarser bristles 16B in order to allow the user 100 to clean his or her toe nails, while the bristles 16 positioned along the top surface 14T may have softer bristles 16B in order to clean the foot top portion 12F.

The scrub brushes 16 can also be equipped with massage tips. Thus, through strategic placement of the scrub brushes 16, such as to contact nerve endings in the feet, the scrub brushes 16 can provide a foot massage while cleaning the foot.

Generally, the roller brushes 18 are positioned near the foot receptacle bottom surface 14B, within the interior volume of the foot receptacle 14, said roller brushes 18 being situated between the bottom channels 24, however the roller brushes 18 may be placed at preferred locations anywhere within the interior volume of the foot receptacle 14. Flexible, roller brush teeth 18T extend outward from the roller brush 18, said teeth 18T massage and clean the foot sole 12S. The roller brushes 18 extend across the receptacle bottom surface 14B between the sides 14S. Thus, when the foot 12 is in place within the receptacle 14, the foot sole 12S rests upon and is supported, in part, by the roller brushes 18. The roller brushes 18 rotate with forward and rearward motion of the foot 12.

The roller brushes 18 are selectively removable from the foot receptacle 14, thereby allowing said roller brushes 18 to be cleaned or interchanged with new roller brushes 18, scrub brushes 16, or other accessories (not shown) such as massagers, softeners, pumicers, or smoothers. Each roller brush 18 has a pair of opposed ends 18E, and a central axle 18A extending there-between about which the brushes 18 rotates. A locking pin 18P extends outward from each end 18E of the roller brush 18, each pin 18P being selectively connectable with one of a plurality of pin holes 17 positioned along the receptacle flange 14L, near the bottom surface 14B. The harder material of the foot receptacle flange 14L provides stability for the attachment of the roller brushes 18, as well as providing a solid receptacle to which to attach the sole 28.

Figure 3:
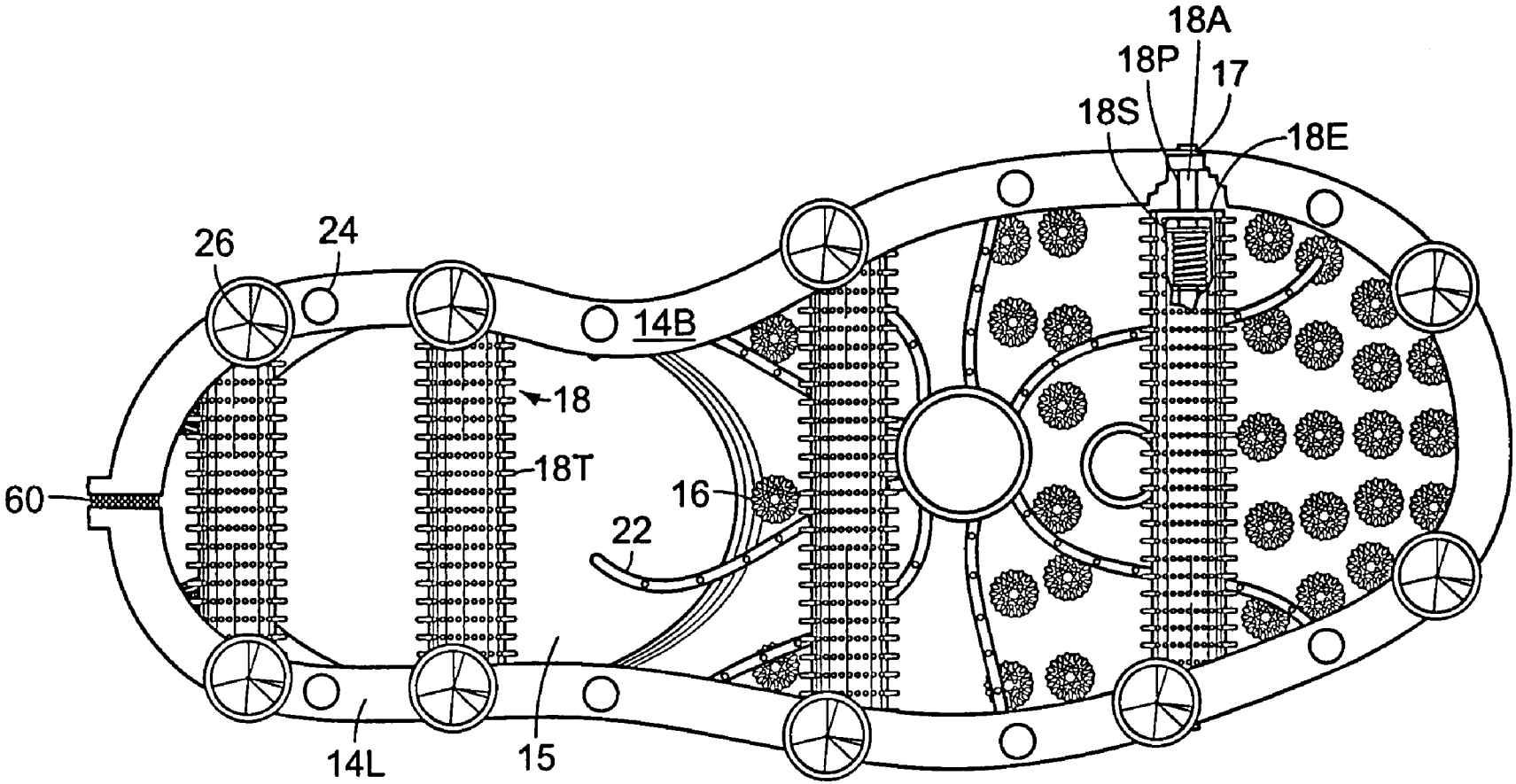
FIG. 3. is a bottom plan view of the foot cleaning device, with the sole portion removed.

Further, as illustrated in FIG. 3, a spring 18S is situated between the roller brush locking pin 18P and the roller brush axle 18A. Upon pushing the roller brush 18 towards one of the receptacle sides 14S, the roller brush spring 18S compresses, thereby allowing the opposite pin 18P to be removed from the pin hole 17. Thus, the roller brush 18 may be removed from the foot receptacle 14. A variety of means may act as the spring 18S, such as metallic coiled springs, elastomers, and hydraulic devices.

A coupling 36 is attached to an inlet pipe bottom end 38B. Coupling 36 is removably attachable at the foot receptacle top surface 14T, generally anticipated to be manifold 37. Attachment may be accomplished through a number of means—threads, grooves, springs, push buttons, and the like—in which the coupling 36 is mated to the manifold 37. Communication, or flow, of the liquid (not shown) and additives (not shown), often a water and soap mixture (not shown), extends through the foot receptacle top surface 14T, the coupling 36, and into the manifold 37. Thus, the inlet pipe 38 (FIG. 2) provides an avenue for liquid (not shown) and additives (not shown) to be directed into the foot receptacle 14.

The manifold has a plurality of apertures (not shown), to which spray jet tubes 22 are attached. The spray jet tubes 22 extend outwardly and downwardly from the manifold 37 throughout the interior of the foot receptacle 14. The spray jet tubes 22 are snake-like flexible tubes that can be interspersed within the receptacle interior. Along each spray jet tube 22 are a plurality of spray jets 22A through which the liquid (not shown) and additives (not shown) are dispensed, similar to a sprinkler. These spray jet tubes 22 disseminate the liquid (not shown) and additives (not shown) throughout the entire foot receptacle 14. Because of the possibility of the spray jet tubes 22 clogging from particulate mater (not shown) in the liquid (not shown), it is anticipated that one or more particle filters (not shown) may be installed in the liquid dispensing assembly 20, within the inlet pipe 38, or in the manifold 37. The particle filters (not shown) act to resist clogging of the spray jets 22A by reducing particulate matter (not shown) that enters the spray jet tubes 22, and they allow for easier cleaning and removal of the particulate matter (not shown) because the particulate matter (not shown) is collected at a single place. Due to the pressure exerted by the liquid (not shown) on the spray jet tubes 22 as the liquid (not shown) travels through the liquid dispensing assembly 20 and out of the spray jets 22A, the spray jet tubes 22 are attached to the foot receptacle 14 in order to maintain the positions of the spray jet tubes 22. It is advantageous for the spray jet tubes 22 and the manifold 37 to be removably attached to the foot receptacle 14 for cleaning or replacement. Additionally, being removably attachable makes the spray jet tubes 22 reconfigurable within the foot receptacle 14.

An alternative embodiment allows for the powered rotation of the roller brushes 18. The roller brushes 18 are in operative communication with the liquid dispensing assembly 20 such that liquid pressure within the liquid dispensing assembly 20 causes the roller brushes 18 to rotate. More specifically, an impeller (not shown) may be placed in operative communication with the roller brushes 18 and connected to the manifold 37, possibly via a spray jet tube 22. When liquid (not shown) is run though the manifold 37 and to the impeller (not shown), the impeller (not shown) causes the roller brushes 18 to rotate without requiring movement of the foot 12. By using an external pump (not shown) and adapting it to the existing liquid flow network, or placing the manifold in communication with a pressurized liquid source (not shown), the required liquid pressure to rotate the roller brushes 18 may be developed. Some rotational resistance created by the weight of the foot 12 will be defeated and the roller brushes 18 will be rotated against the foot 12.

It is anticipated that all, or most, of the parts of the foot cleaning device 10 can be disassembled for storage, packing, cleaning, and the like. Thus, the foot receptacle 14 and its component parts, the scrub brushes 16, the roller brushes 18, the liquid dispensing assembly 20, the additive dispensing assembly 44, as well as the other pieces can be taken apart by the user.

Figure 2:
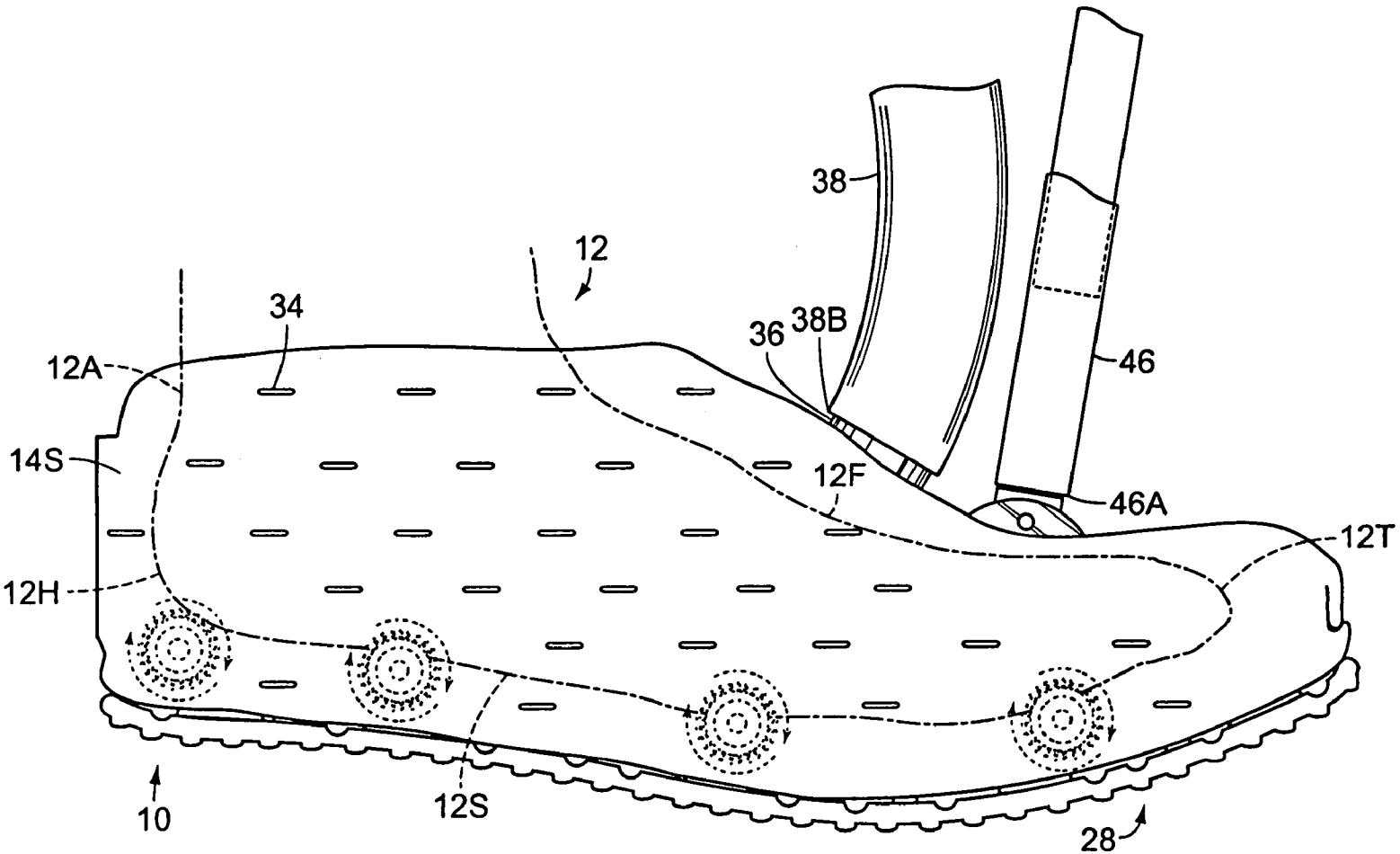
FIG. 2. is a side elevational view of the foot cleaning device, with a foot extending therein shown in broken lines, illustrating rotation of the roller brushes.

FIG. 2. illustrates a foot 12 inside the foot receptacle 14. The foot receptacle 14 is anticipated to be shaped similarly to a shoe or boot, however the shoe-like shape is not a requirement. The receptacle 14 is sized to accommodate a person's foot, and allow for movement of the foot 12 therein. In an alternative embodiment, the size of the foot receptacle 14 is variable, and can be adjusted from smaller sizes to a larger sizes in order to accommodate different sized feet. In this embodiment, several means of size adjustment are anticipated. Disassembly of the foot receptacle 14 also allows for easier cleaning and maintenance. The foot 12 has a heel 12H, a top portion 12F, toes 12T, a foot sole 12S, and an ankle 12A. The foot receptacle 14 has a substantially open bottom and the bottom surface 14B has a flange 14L that extends inward circumferentially around the receptacle bottom surface 14B. A plurality of perforations 34 are positioned through the receptacles sides 14S. While in use, the water and additives (not shown) dispersed into the receptacle 14 may be drained out of said receptacle 14 in part through these perforations 34.

The foot receptacle 14 further comprises a front opening 58 and a rear opening 60, wherein the openings 58, 60 allow the foot 12 contained within the foot receptacle 14 to move forward and backward to effect contact of the entire foot sole 12S with the roller brushes 18 and to rub the foot against the scrub brushes 16. The front opening 58 is anticipated to be an open toe design in order to allow the toes 12T to be pushed through the front opening 58. The scrub brushes 16 can be placed so that as the foot is slid through the front opening 58, the toes 12T and toe nails (not shown) are cleaned. Similarly, the scrub brushes 16 placement at the rear opening cause the heal 12H to be cleaned.

The open toe design is anticipated to be open and flexible enough to accommodate even large feet, allowing the toes 12T to be pushed through the front opening 58 without restriction, yet not have the sides of the foot receptacle 14S or the foot receptacle front portion 14F fold back as the foot travels in the reverse direction. The rear opening 60 is anticipated to be very similar. The scrub brushes 16 will extend across the rear opening 60, and may even mesh slightly. As the foot 12 moves backward in the foot receptacle 14, the scrub brushes 16 clean the heal 12H. When the foot 12 moves forward again, the foot receptacle rear portion 14R should not fold inwardly to catch on the heal 12H.

In an alternative embodiment, the front opening 58 is a slit in the foot receptacle front portion 14F, and similarly the rear opening 60 is a slit in the foot receptacle rear portion 14R. The openings 58, 60 remain substantially closed until the foot 12 pushes against said openings 58, 60.

FIG. 3. illustrates the foot receptacle bottom surface 14B. The bottom surface 14B is anticipated to be open in specific areas to allow the roller brushes 18 to protrude through as necessary. The bottom surface 14B, including that portion of the foot receptacle flange 14L that makes up a portion of the bottom surface 14B, may have a plurality of suction cups 26 attached thereto. The suction cups 26 are positioned between the channels 24. The suction cups 26 may be used to selectively secure the foot receptacle 14 to a flat surface, such as a bathtub or shower stall base. Thus, the user 100 may move his or her foot 12 within the receptacle 14 in order to clean said foot 12 without moving the device 10.

A sole 28 may be attached to the bottom surface 14B of the foot receptacle 14 in the event that the device 10 is to be used on a slick or uneven surface. The sole 28 has a top surface 28T and a bottom surface 28B, wherein the bottom surface 28B is textured to enhance the grip on a slick or uneven surface. The receptacle bottom surface 14B suction cups 26 are selectively attachable to the smooth top surface 28T of the sole 28. To further secure the sole 28 to the receptacle 14, a plurality of studs 30 extend upward from the sole top surface 28T, said studs 30 capable of interlocking with the bottom channels 24 in order to selectively secure the sole 28 to the foot receptacle 14. If the foot receptacle 14 is manufactured in order that the user 100 can change the size of the foot receptacle 14, then likewise it is advantageous for the sole 28 to be capable of having its size altered by the user 100. It is also anticipated that the sole 28 may be removably attached to the surface of the bathing floor (not shown) in order to provide additional stability for the user 100.

It is also anticipated that the sole may eliminated if a pad (not shown) is used. The pad (not shown) is attachable to the bathing floor (not shown). In this embodiment, rather than take advantage of the relatively high effective coefficient of friction of the sole (as developed by a number of possible means, without limitation suction cups, material selection, and the like), the pad (not shown) may be attached to the bathing floor (not shown) with an adhesive. The pad (not shown), sized to generally match the size of the foot receptacle 14, would create the increased friction with the receptacle bottom surface 14B, allowing for greater stability for the user 100 during use of the foot cleaning device 10. The increased friction could be created by use of a number of means, including without limitation, material selection, surface texturing, shaping, and non-texturing at those points the suction cups 26 contact.

The bottom surface 14B has a plurality of drainage apertures (not shown) extending there-through in order to allow the water (not shown) to drain out of the receptacle 14. The bottom channels 24 also assist in draining liquids (not shown) from the interior of the foot receptacle 14. The sole top surface 28T has a plurality of transverse grooves 32 positioned on either side of the studs 30, extending substantially between the sides 14S to allow liquids (not shown) to drain out from between the bottom 14B and the sole 28. Thus, liquids (not shown) drain out of the foot receptacle 14, and when the sole 28 is attached to the foot receptacle 14, the water (not shown) contained within said receptacle 14 drains through the grooves 32 at the sides 14S.

Figure 4:
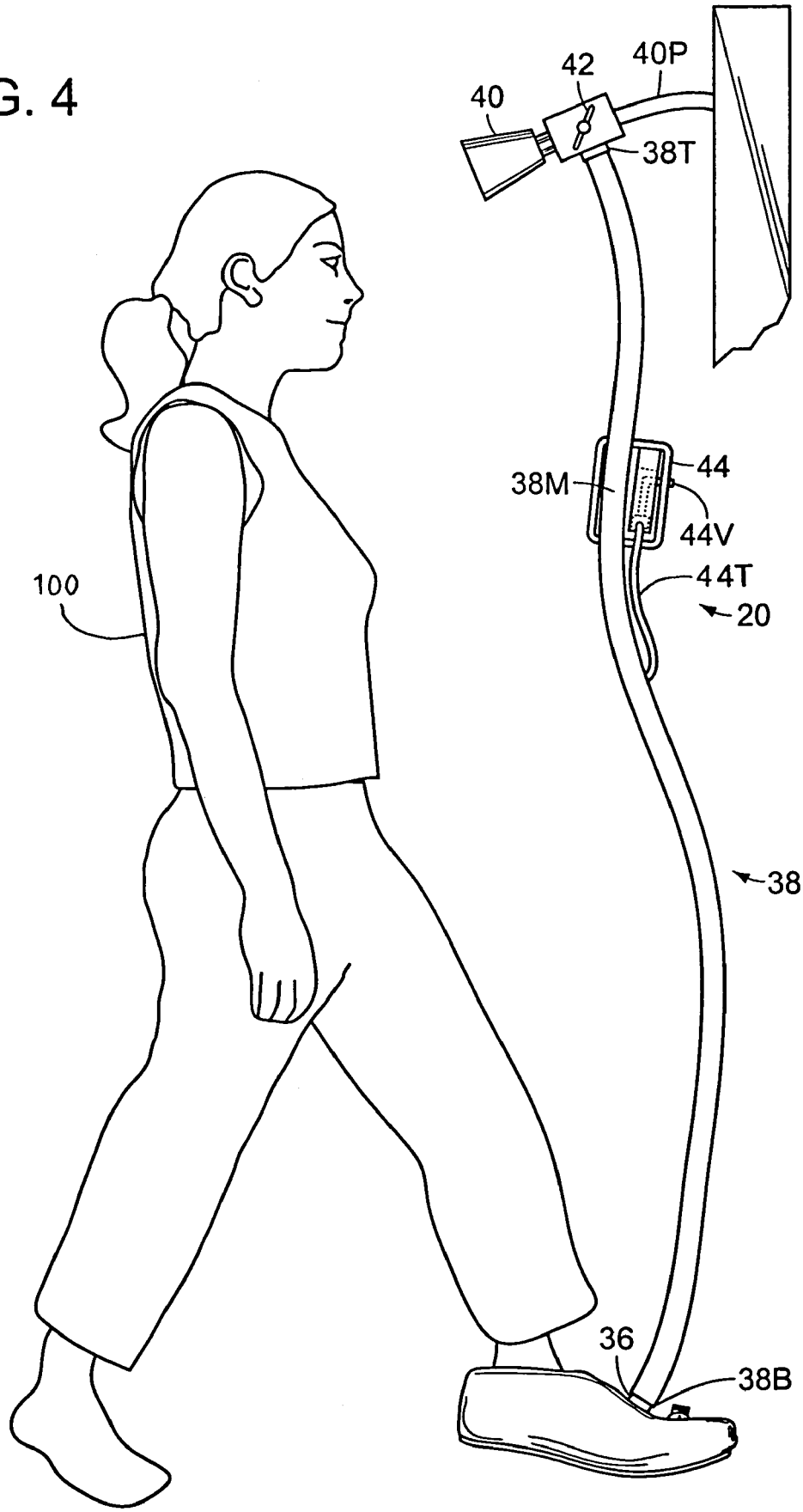
FIG. 4. is a side elevational view of the foot cleaning device in use.

FIG. 4. illustrates a user 100 with her foot 12 positioned in the foot cleaning device 10. This figure indicates how the liquid dispensing assembly 20 channels liquid (not shown) into the receptacle 14. The liquid dispensing assembly 20 is used to disperse liquid (not shown) and additives (not shown) throughout the receptacle 14. It is anticipated that the liquid (not shown) will generally be water (not shown), and that the additives (not shown) may include soap, cleaners, pumicing agents, fragrances, moisturizers, softeners, medications, disinfectants, anti-bacterial agents, and anti-fungal agents, and other substances that the user 100 may wish to use in the treatment of the foot 12. Because of the possibility of various types of additives (not shown) being passed through the liquid dispensing assembly 20, it is advantageous for the liquid dispensing assembly 20 to be made from materials that are chemically resistant. The liquid dispensing assembly 20 essentially comprises an inlet pipe 38 that extends between the foot receptacle 14 and a shower head 40, said shower head 40 having a shower head pipe 40P. The inlet pipe 38 has a top end 38T and a bottom end 38B, wherein the pipe bottom end 38B is mated with a coupling 36 situated on the top surface 14T of the receptacle 14. A valve 42 is situated at the pipe top end 38T, said valve 42 being in communication with the shower head pipe 40P. Thus, when the valve 42 is turned to the "On" position, water (not shown) from the shower head pipe 40P is partially or fully diverted into the inlet pipe 38. The water (not shown) then flows downward and into the foot receptacle 14. A first additive dispensing assembly 44 is attached to the inlet pipe 38 at a midway point 38M. A additive dispensing assembly valve 44V controls flow of the additive (not shown) from the first additive dispensing assembly 44 into the inlet pipe 38. As shown in FIG. 4, the first additive dispensing assembly 44 is isolated from the inlet pipe 38 except for an additive dispensing assembly tube 44T. Alternatively, the first additive dispensing assembly 44 may be attached within the inlet pipe 38, and have separate channels (not shown) through which liquid (not shown) can flow, controlled by the additive dispensing assembly valve 44V. In one channel (not shown) an additive (not shown) could be placed for introduction into the liquid (not shown) and, ultimately, the foot receptacle 14. Again alternatively, if there is no additive dispensing assembly valve 44V, then water (not shown) can be allowed to flow over the additive (not shown) in the first additive dispensing assembly 44 to release the additive into the foot receptacle 14.

Figure 5:
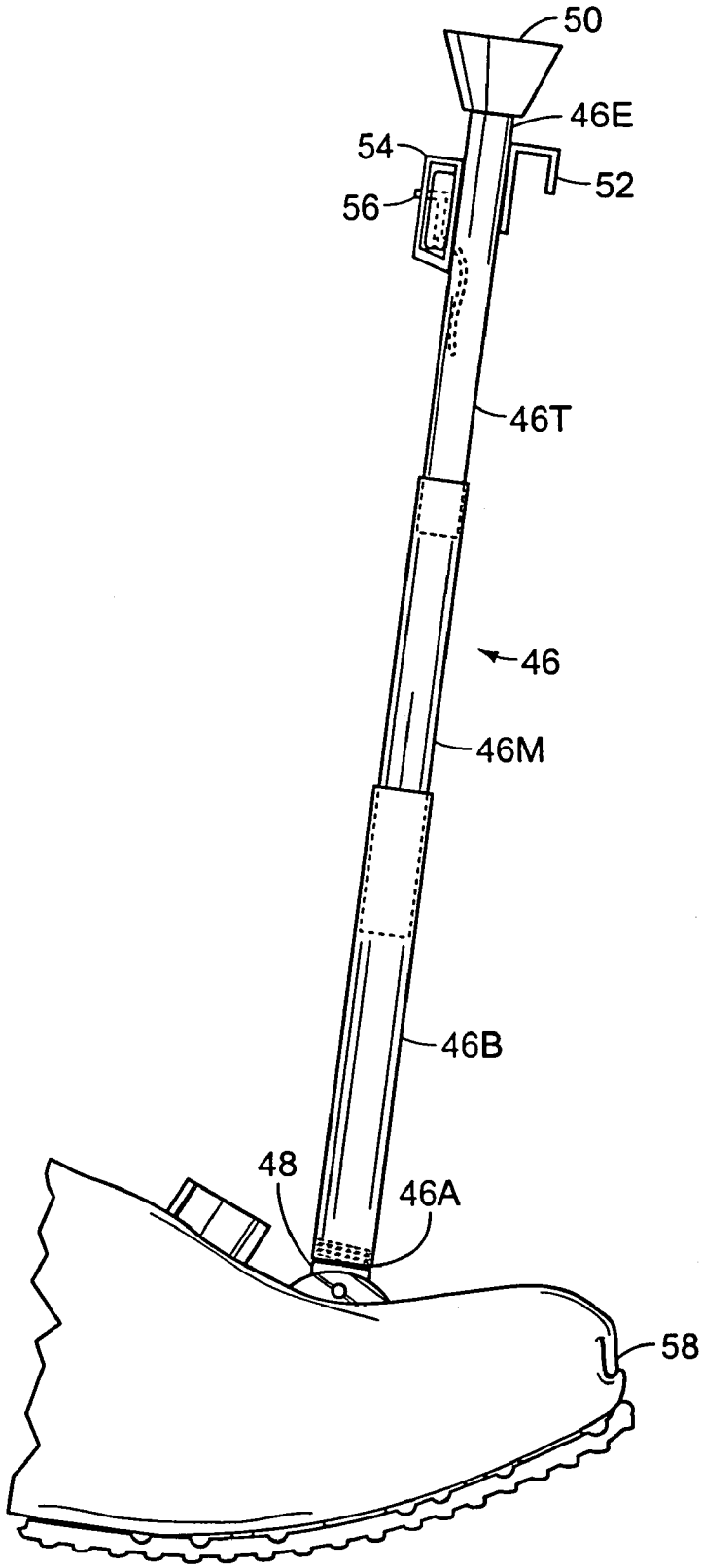
FIG. 5. is a side elevational view of the inlet tube attached to the foot receptacle.

FIG. 5. illustrates a shaft 46 that is selectively coupled with a nipple 48 positioned adjacent to the coupling 36 on the foot receptacle top surface 14T. There are a number of means by which the shaft 46 can be attached to the nipple 48, such as threads, grooves, springs, push buttons, and the like. The shaft 46 and nipple 48 act functionally similar to the inlet pipe 38 and coupling 36 as described above. However, they allow the foot cleaning device 10 to be used independent of an existing liquid supply, such as a shower head 40 or faucet (not shown). Instead, runoff fluid can be directed into the shaft 46, which is hollow. The liquid (not shown) travels through the shaft 46 and through the nipple 48. Liquid (not shown) and additives (not shown) that exit the nipple 48 are deposited on the foot receptacle top surface 14T which has a plurality of apertures that allow the liquid (not shown) and additives (not shown) to drain into the interior of the foot cleaning device 10.

The top portion 46T has a top end 46E with a funnel 50 attached thereto. The funnel 50 allows the user 100 to direct water (not shown) and additives (not shown) into the shaft 46. The top portion 46T further comprises a hook 52 and a second additive dispensing assembly 54. The second additive dispensing assembly 54 is in communication with the shaft 46, said second additive dispensing assembly 54 having a shaft additive valve 56 for controlling the dispersal of the additives (not shown) contained therein. As with the first additive dispensing assembly 44, the second additive dispensing assembly 54 may be used to introduce additives (not shown) such as soap, fragrances, moisturizers, softeners, medications, such anti-bacterial and anti-fungal agents, and other substances that the user 100 may wish to use in the treatment of the foot 12, into the water (not shown). It may be advantageous for the funnel 50 to be made of flexible material so that the shape of the funnel 50 can be elastically altered by the user 100 in order to better control fluid or additive capture and flow rate.

The shaft bottom portion 46B has a bottom end 46A, said bottom end 46A having internal threading for mating the bottom portion 46B with the threaded nipple 48. The threaded nipple 48 is pivotally connected to the receptacle top surface 14T to allow for movement of the shaft 46. If either of the liquid dispensing assembly 20 or the shaft 46 are not in use, then the coupling 36 or the nipple 48 can be capped if the user 100 desires to do so. This is more important with the coupling 36 so that particulate matter does not enter the spray jet tubes 22 and clog the spray jets 22A The shaft 46 empties its contents, the water (not shown) and additives (not shown), onto the foot receptacle top surface 14T. The contents (not shown) are then directed into the interior of the foot receptacle 14 through a plurality of apertures (not shown) in the foot receptacle top surface 14T. This action may be further encouraged, and dispersal of the contents (not shown) discouraged, by means of a raised ridge (not shown) circumscribing the foot receptacle top surface 14T. The ridge (not shown) would contain the contents (not shown) pending their draining through the apertures (not shown) in the foot receptacle top surface 14T. Dispersed drainage into the foot receptacle 14 may be encouraged through the incorporation of channels (not shown) along the foot receptacle top surface 14T, and through the use of various shaped shaft bottom portion bottom ends 46A. Additionally, the nipple 48 may have flared edges to assist in directing dispersal of the contents (not shown) over the foot receptacle top surface 14T. The ridge (not shown) also allows the user 100 to place additives (not shown) directly on the foot receptacle top surface 14T, and allow water (not shown) to wash the additives (not shown) into the foot receptacle 14.

The length of the shaft 46 is designed to be height adjustable so as to best fit the user 100. Because potential users 100 come in a variety of heights, telescoping portions of the shaft 46 may be of any number and length that best fit the desired result. In one embodiment, as shown in this figure, there are three telescoping portions, namely a shaft bottom portion 46B, a shaft middle portion 46M, and a shaft top portion 46T. It is intended that the telescoping portions 46B, 46M, and 46T, of the shaft 46, extend and retract in operative engagement with one-another, however when the telescoping portions 46B, 46M, and 46T, are positioned so that the shaft 46 has the user's 100 desired length, the relative positions of the telescoping portions 46B, 46M, and 46T, and thus the length of the shaft 46, can be temporarily fixed. There are a number of means by which this can be accomplished, such as threads, grooves, springs, push buttons, varying diameters of the telescoping portions 46B, 46M, and 46T, and the like.

Figure 6:
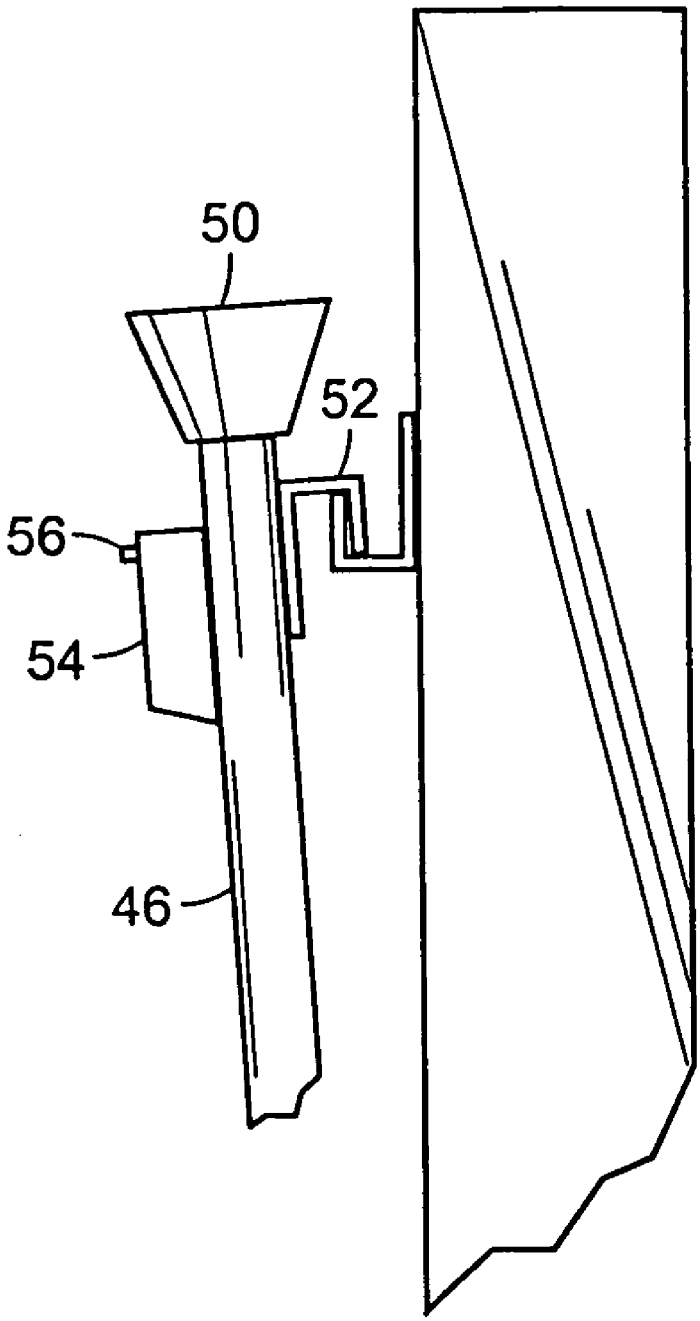
FIG. 6. is a side elevational view of the inlet tube mounted on a wall hook.

FIG. 6. illustrates that the shaft 46 can be equipped with a hook 52 that may be removably attached to a substrate, such as the shower wall, for ease of use or for storage when the foot cleaning device 10 is not in use.

In conclusion, herein is presented a foot cleaning device for thoroughly cleaning a user's foot without having to raise the foot or bend downward towards the foot. The invention is illustrated by example in the drawing figures, and throughout the written description. Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

a liquid dispensing assembly attached to said foot receptacle, wherein said liquid dispensing assembly is in communication with said interior of said foot receptacle; and wherein said foot receptacle rear portion has a rear opening and said foot receptacle front portion has a front opening.

2. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

a liquid dispensing assembly attached to said foot receptacle, wherein said liquid dispensing assembly is in communication with said interior of said foot receptacle;

wherein said cleaning pieces are roller brushes, said roller brushes being rotatable, and having a plurality of flexible teeth capable of cleaning, smoothing, softening, pumicing, or massaging said foot; and wherein each roller brush further comprises a pair of opposed ends, and a locking pin extended outward from each end, and said foot receptacle sides further comprise a plurality of holes, wherein said roller brush locking pins are mated with said foot receptacle holes for holding said roller brushes in place within said foot receptacle.

3. The foot cleaning device of claim 2, wherein each roller brush further comprises a spring, said spring positioned to urge one of said locking pins outward, wherein said roller brush is selectively removable from said foot receptacle by pushing said roller brush to compress said spring and allow the opposite pin to be removed from the corresponding hole.

4. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle; and wherein said receptacle has a substantially open bottom and said foot receptacle has a flange extending circumferentially around said receptacle bottom, and further comprising a plurality of bottom channels extending through said foot receptacle bottom flange.

5. The foot cleaning device of claim 4, further comprising a plurality of suction cups attached to said bottom surface, said suction cups used to selectively secure said foot cleaning device to a flat surface.

6. The foot cleaning device of claim 5, further comprising a sole that may be attached to said foot receptacle bottom surface, wherein said sole has a top surface and a textured bottom surface.

7. The foot cleaning device of claim 6, wherein said foot receptacle bottom surface suction cups are attachable to said top surface of said sole in order to secure said sole to said foot receptacle.

8. The foot cleaning device of claim 6, said sole further comprising a plurality of studs extending upward from said sole top surface, said studs capable of interlocking with said foot receptacle bottom channels in order to selectively secure said sole to said foot receptacle.

9. The foot cleaning device of claim 8, wherein said sole top surface further comprises a plurality of transverse grooves, wherein upon securing said sole to said foot receptacle said liquid contained within said receptacle may be drained.

10. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted, a plurality of cleaning pieces positioned within said interior of said foot receptacle;

an liquid dispensing assembly attached to said foot receptacle, wherein said liquid dispensing assembly is in communication with said interior of said foot receptacle;

wherein said cleaning pieces are a combination of scrub brushes, each having a head and a plurality of bristles emanating from said head, and wherein said scrub brushes are distributed throughout said foot receptacle in order to allow selected parts of said foot to be cleaned, and roller brushes, said roller brushes being rotatable; and wherein said receptacle has a substantially open bottom and said foot receptacle has a flange extending circumferentially around said receptacle bottom, and further comprising a plurality of bottom channels extending through said foot receptacle flange, and wherein said roller brushes are situated between said foot receptacle bottom channels.

11. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle; and further comprising a plurality of perforations through said foot receptacle sides, wherein said perforations allow water and additives drain out of said interior of said foot receptacle.

12. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle; and further comprising a plurality of perforations through said foot receptacle bottom surface, wherein said perforations allow water and additives drain out of said interior of said foot receptacle.

13. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle;

wherein said cleaning pieces are a combination of scrub brushes, each having a head and a plurality of bristles emanating from said head, and wherein said scrub brushes are distributed throughout said foot receptacle in order to allow selected parts of said foot to be cleaned, and roller brushes, said roller brushes being rotatable; and further comprising a plurality of perforations through said foot receptacle sides, wherein said perforations allow water and additives drain out of said interior of said foot receptacle.

14. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle; and wherein said foot receptacle size is adjustable in order to accommodate said foot while allowing for movement of said foot therein.

15. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle;

wherein said cleaning pieces are a combination of scrub brushes, each having a head and a plurality of bristles emanating from said head, and wherein said scrub brushes are distributed throughout said foot receptacle in order to allow selected parts of said foot to be cleaned, and roller brushes, said roller brushes being rotatable; and wherein said foot receptacle size is adjustable in order to accommodate said foot while allowing for movement of said foot therein.

16. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle wherein said liquid dispensing assembly is used in conjunction with a liquid source, said liquid dispensing assembly comprising:

an inlet pipe;

a coupling for removably attaching said inlet pipe to said foot receptacle top surface; and said inlet pipe further comprising a top end for communicating with said liquid source, a mid point, and a bottom end for mating with said coupling.

17. The foot cleaning device of claim 16, wherein said water dispensing assembly further comprises an additive dispensing assembly attached to said inlet pipe mid point, said additive dispensing assembly having a reservoir valve in communication with said inlet pipe for controlling flow of additive from said reservoir into said inlet pipe.

18. The foot cleaning device of claim 16 wherein said liquid dispensing assembly further comprises a plurality of spray jet tubes positioned in said interior of said foot receptacle, said spray jets extending downward from said coupling, and said spray jet tubes having a spray jet wherein said spray jet distributes liquid from said inlet pipe into said foot receptacle.

19. The foot cleaning device of claim 16, wherein said coupling further comprises a threaded member, and said inlet pipe bottom end has threading for mating with said threaded member.

20. The foot cleaning device of claim 16, further comprising a funnel positioned on said shaft top end, such that when liquid is directed into said funnel, said liquid travels through said shaft into said foot receptacle interior.

21. The foot cleaning device of claim 16, wherein said liquid dispensing assembly shaft comprises a series of telescoping portions.

22. The foot cleaning device of claim 21, wherein said telescoping portions include a bottom portion, a middle portion, and a top portion.

23. The foot cleaning device of claim 22, wherein said liquid dispensing assembly shaft top portion further comprises a shaft additive dispensing assembly for containing a quantity of additive, said reservoir having a shaft additive valve in communication with said shaft for controlling dispersal of additive from said reservoir into said shaft.

24. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle;

a hollow nipple;

a hollow shaft removably attachable to said nipple;

said nipple attached to said foot receptacle and positioned above said foot receptacle top surface; and said foot receptacle top surface having a plurality of apertures.

25. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a plurality of cleaning pieces positioned within said interior of said foot receptacle;

an liquid dispensing assembly attached to said foot receptacle, wherein said liquid dispensing assembly is in communication with said interior of said foot receptacle;

wherein said cleaning pieces are roller brushes, said roller brushes being rotatable, and having a plurality of flexible teeth capable of cleaning, smoothing, softening, pumicing, or massaging said foot; and wherein said roller brush is in operative communication with said liquid dispensing assembly such that liquid pressure within said liquid dispensing assembly causes said roller brush to rotate.

26. A foot cleaning device for cleaning a foot, comprising:

a foot receptacle for accommodating said user's foot, said foot receptacle having a top surface, a bottom surface, a front portion, a rear portion, and a pair of sides, whereby an interior volume is formed, and wherein said foot receptacle has an opening through which said foot may be inserted;

a scrub brush positioned within said interior of said foot receptacle, said scrub brush having a head and a plurality of bristles emanating from said head;

a roller brush positioned within said interior of said foot receptacle, said roller brush rotatable, and having a plurality of flexible teeth;

an liquid dispensing assembly attached to said foot receptacle, wherein said liquid dispensing assembly is in communication with said interior of said foot receptacle.

27. The foot cleaning device of claim 26, wherein said foot receptacle, said scrub brush, said roller brush, and said liquid dispensing assembly can be disassembled.

* * * * *